US009599420B2

(12) United States Patent
Moretti

(10) Patent No.: US 9,599,420 B2
(45) Date of Patent: Mar. 21, 2017

(54) INTERCHANGEABLE TRIGGER ASSEMBLY FOR FIREARMS

(71) Applicant: BENELLI ARMI S.p.A., Urbino (Pesaro Urbino) (IT)

(72) Inventor: Luigi Moretti, Collebeato (IT)

(73) Assignee: BENELLI ARMI, S.P.A, Pesaro Urbino (IT)

( * ) Notice: Subject to any disclaimer, the term of this patent is extended or adjusted under 35 U.S.C. 154(b) by 0 days.

(21) Appl. No.: 14/980,499

(22) Filed: Dec. 28, 2015

(65) Prior Publication Data

US 2016/0187091 A1 Jun. 30, 2016

(30) Foreign Application Priority Data

Dec. 30, 2014 (IT) ..... MI2014A002274

(51) Int. Cl.

| | |
|---|---|
| ***F41A 3/00*** | (2006.01) |
| ***F41A 19/10*** | (2006.01) |
| ***F41A 19/42*** | (2006.01) |
| ***F41A 3/58*** | (2006.01) |
| ***F41A 19/15*** | (2006.01) |
| ***F41A 19/54*** | (2006.01) |

(52) U.S. Cl.

CPC ..... *F41A 19/10* (2013.01); *F41A 3/58* (2013.01); *F41A 19/15* (2013.01); *F41A 19/42* (2013.01); *F41A 19/54* (2013.01)

(58) Field of Classification Search

USPC ..... 42/8, 69.01; 89/1.41, 132

See application file for complete search history.

(56) References Cited

U.S. PATENT DOCUMENTS

| | | | | |
|---|---|---|---|---|
| 5,657,567 | A | 8/1997 | Beretta | |
| 6,935,063 | B1 * | 8/2005 | Johnson | F41A 1/08 42/40 |
| 2006/0053672 | A1 * | 3/2006 | Popikow | F41A 19/21 42/42.01 |

FOREIGN PATENT DOCUMENTS

| | | | |
|---|---|---|---|
| BE | 900065 | A1 | 1/1985 |
| DE | 155 929 | C | 11/1903 |
| EP | 0 437 736 | A2 | 7/1991 |
| EP | 2541186 | A1 | 1/2013 |
| WO | WO 02/084199 | A1 | 10/2002 |

* cited by examiner

*Primary Examiner* — J. Woodrow Eldred

(74) *Attorney, Agent, or Firm* — R. Neil Sudol; Henry D. Coleman

(57) ABSTRACT

An interchangeable trigger assembly for firearms, particularly for over/under shotguns, which can be applied within a break action of a gun, by insertion in a lower opening of the break action; the assembly includes two detachable portions: a firing unit and a trigger unit, the firing unit including firing members; the trigger unit including at least one trigger which acts on actuation members of the firing members.

15 Claims, 11 Drawing Sheets

INTERCHANGEABLE TRIGGER ASSEMBLY FOR FIREARMS

BACKGROUND OF THE INVENTION

The present invention relates to an interchangeable trigger assembly for firearms, particularly for over/under shotguns.

As is known, the trigger mechanism of a firearm can be provided in the form of a unit that can be extracted from the body of the firearm.

For example, in the field of over/under hunting and target-shooting rifles it is known to use trigger mechanisms, both of the single trigger and of the double trigger type, mounted on a support which is known as trigger plate and can be applied to the lower part of the break action of the rifle at an adapted opening or cutout.

Such a removable trigger mechanism normally includes a frame and fitted therein are the trigger, the shot selection mechanism, the trigger system composed of levers and hammers or cocks, with their own springs and adapted to strike the firing pins, mounted on the break action.

The safety systems of the firearm also are normally mounted in the break action.

U.S. Pat. No. 5,657,567 describes a removable trigger mechanism of the type mentioned above.

DE155929 describes a removable trigger assembly that comprises a frame which includes two triggers, firing pins, a firing pin actuation mechanism and a part of the firearm safety system.

EP2541186 describes an interchangeable trigger assembly for firearms that is completely interchangeable and encloses within itself various actuation systems, including the firing pin trigger system, the firearm safety actuation system, with an optional device for automatic engagement during the opening of the firearm, the system for the engagement and release of the casing that contains the entire assembly.

WO02084199 discloses a universally applicable locking system for a multi-barreled weapon, having a change-over mechanism that contains a base body that can be displaced in the direction of the longitudinal axis of the rifle, and has a trigger lever that is pivotally mounted on said base body and can be actuated by the trigger. The trigger lever only engages with the trigger rod allocated to the second firing pin to fire the second shot after the weapon kickback. The trigger unit is removable as in other conventional systems.

OBJECTS OF THE INVENTION

The aim of the present invention is to provide an interchangeable trigger assembly that allows to vary the functional characteristics of the firearm rapidly and easily, providing the user with trigger assemblies with different characteristics that can be applied selectively to the same firearm according to the specific requirements.

Within the scope of this aim, an object of the invention is to provide an interchangeable trigger assembly that allows to vary the functional characteristics of the firearm without the intervention of specialized personnel.

Another object of the invention is to provide a modular trigger assembly that is advantageous from the production standpoint both in terms of ease of assembly and in terms of the possibility to use common components for firearms of a different type, for example with different calibers.

Another object of the present invention is to provide a trigger assembly which, by virtue of its particular constructive characteristics, is capable of giving the greatest assurances of reliability and safety in use.

SUMMARY OF THE INVENTION

This aim and other objects that will become better apparent hereinafter are achieved by an interchangeable trigger assembly for firearms, to be applied within a is break action of a rifle by insertion in a lower opening of said break action; said interchangeable assembly comprising two detachable portions: a firing unit and a trigger unit, said firing unit comprising firing members; said trigger unit comprising at least one trigger which acts on actuation members of said firing members; said firing unit being detachably associated with said trigger unit.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
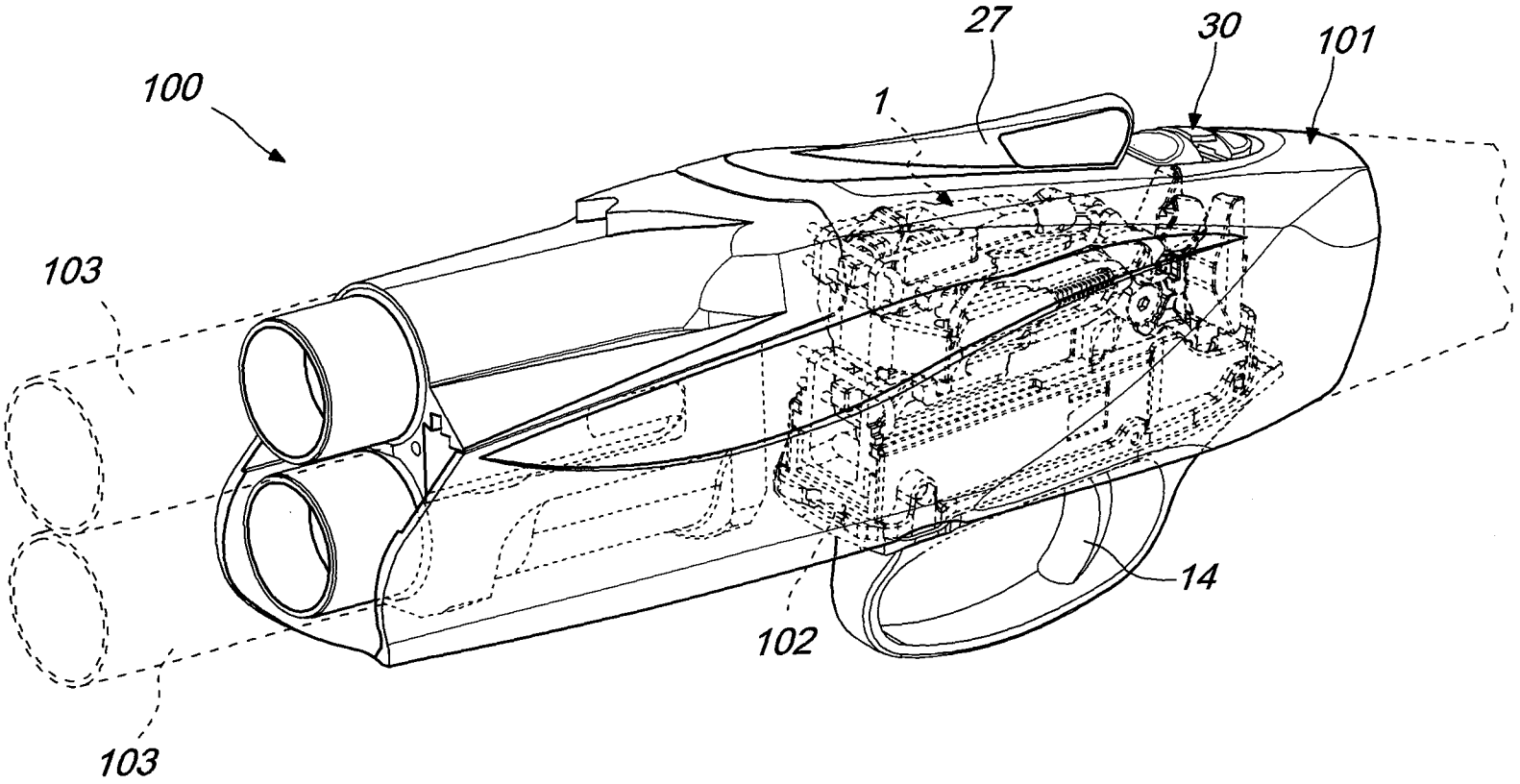
FIG. 1 is a perspective view of a portion of an over/under rifle, in which the trigger assembly according to the present invention is visible in phantom lines.
Figure 2:
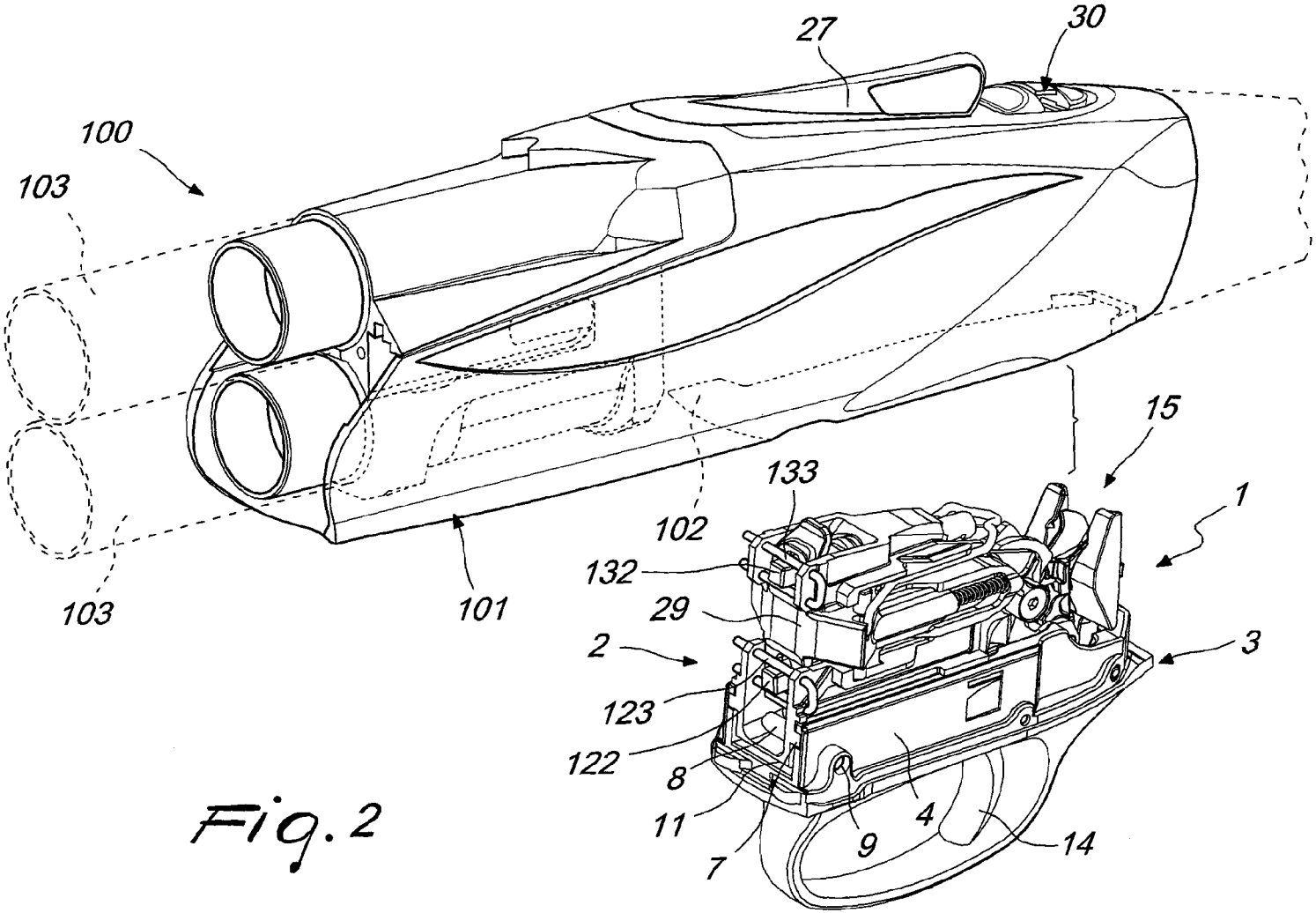
FIG. 2 is a perspective view, similar to the preceding one, showing the trigger assembly removed from the body of the firearm.
Figure 3:
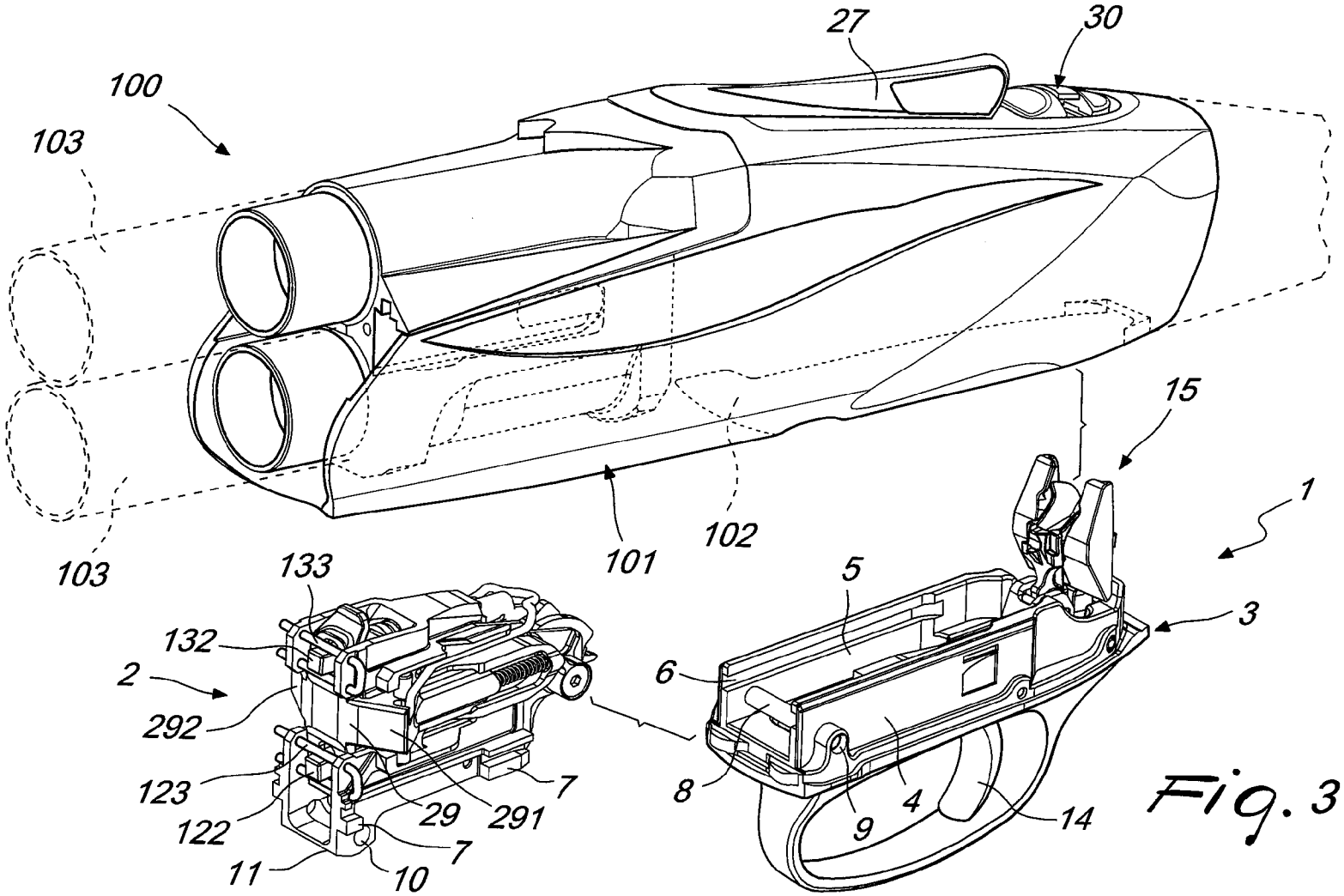
FIG. 3 is a perspective view, similar to the preceding one, showing the trigger assembly removed from the body of the firearm and disassembled into its two components.
Figure 4:
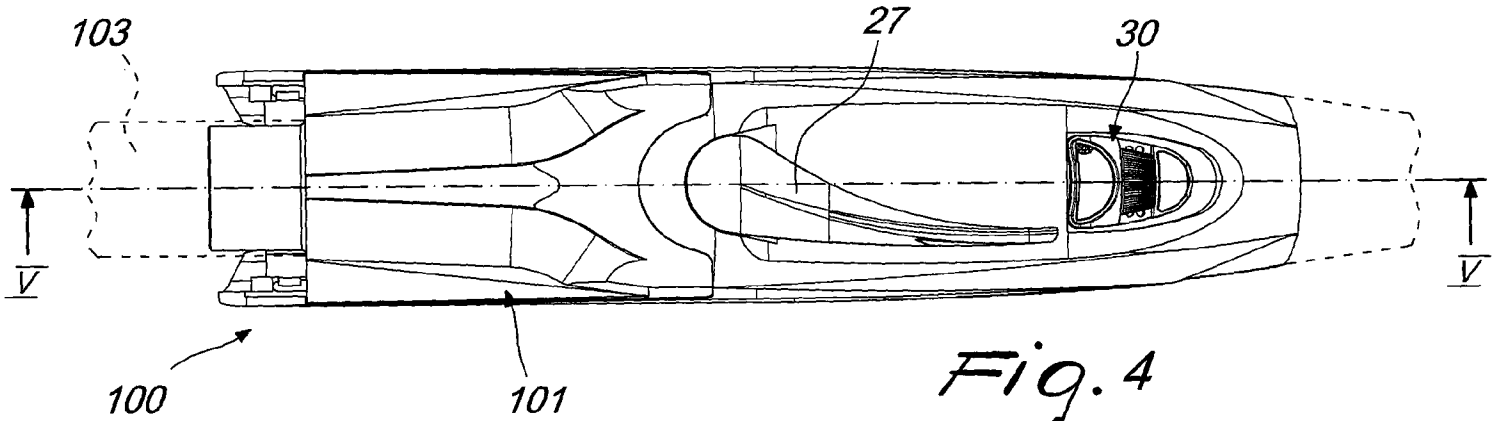
FIG. 4 is a plan view of the portion of rifle of the preceding figures.
Figure 5:
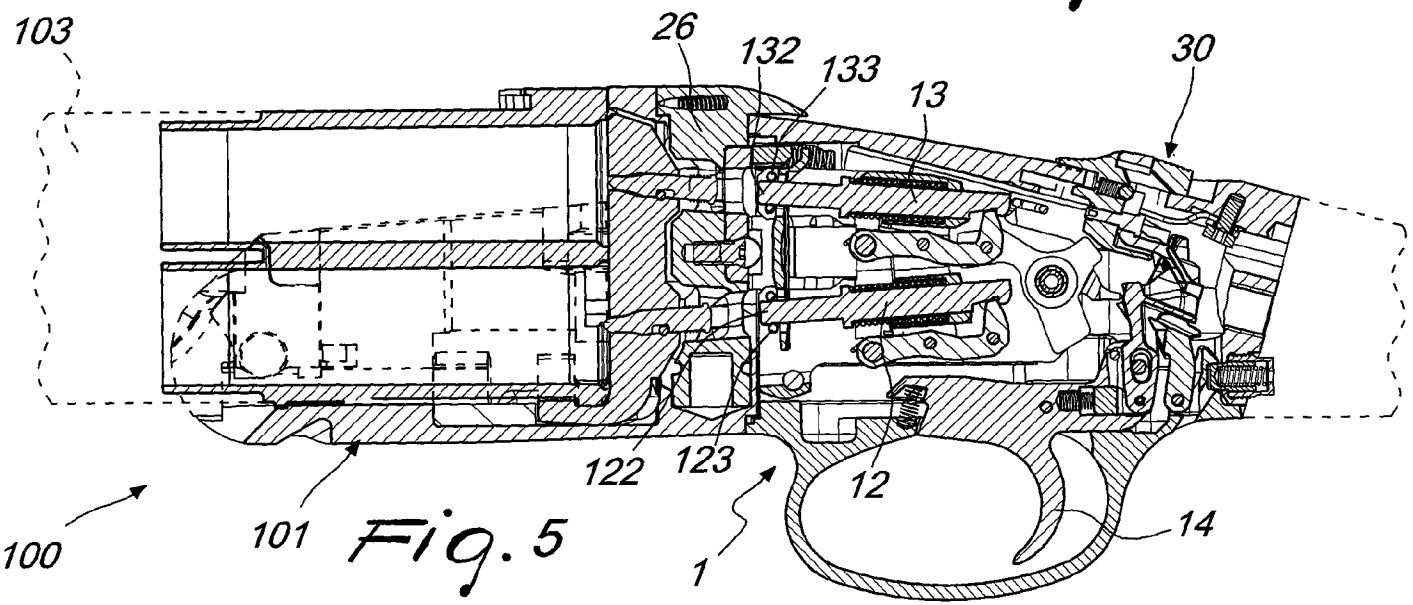
FIG. 5 is a longitudinally sectional side view, taken along the sectional plane V-V of FIG. 4.
Figure 6:
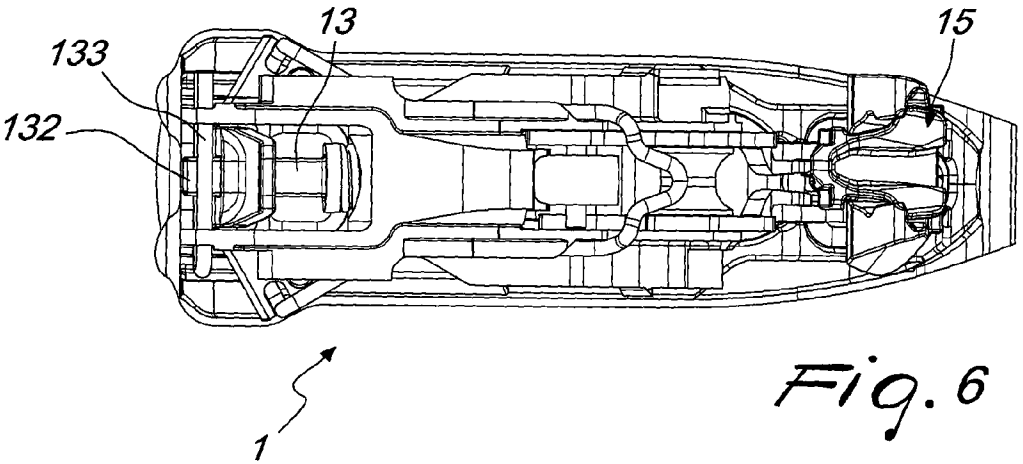
FIG. 6 is a plan view of the trigger assembly.
Figure 7:
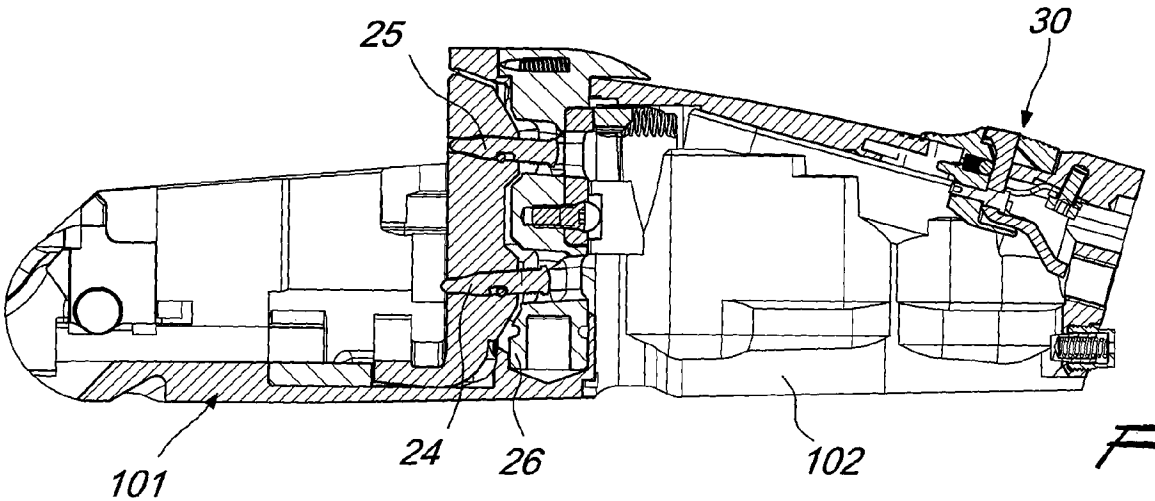
FIG. 7 is a longitudinal sectional lateral elevation view of the break action of the firearm.
Figure 8:
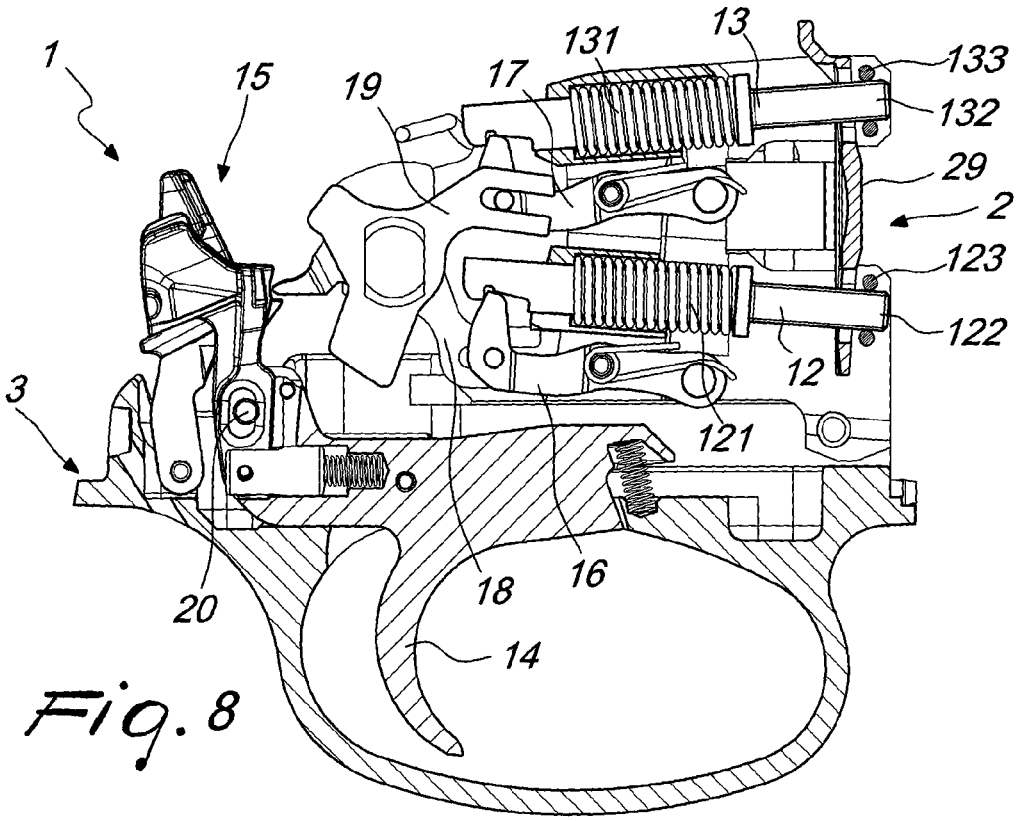
FIG. 8 is a partially sectional side view of the right side of the trigger assembly.
Figure 9:
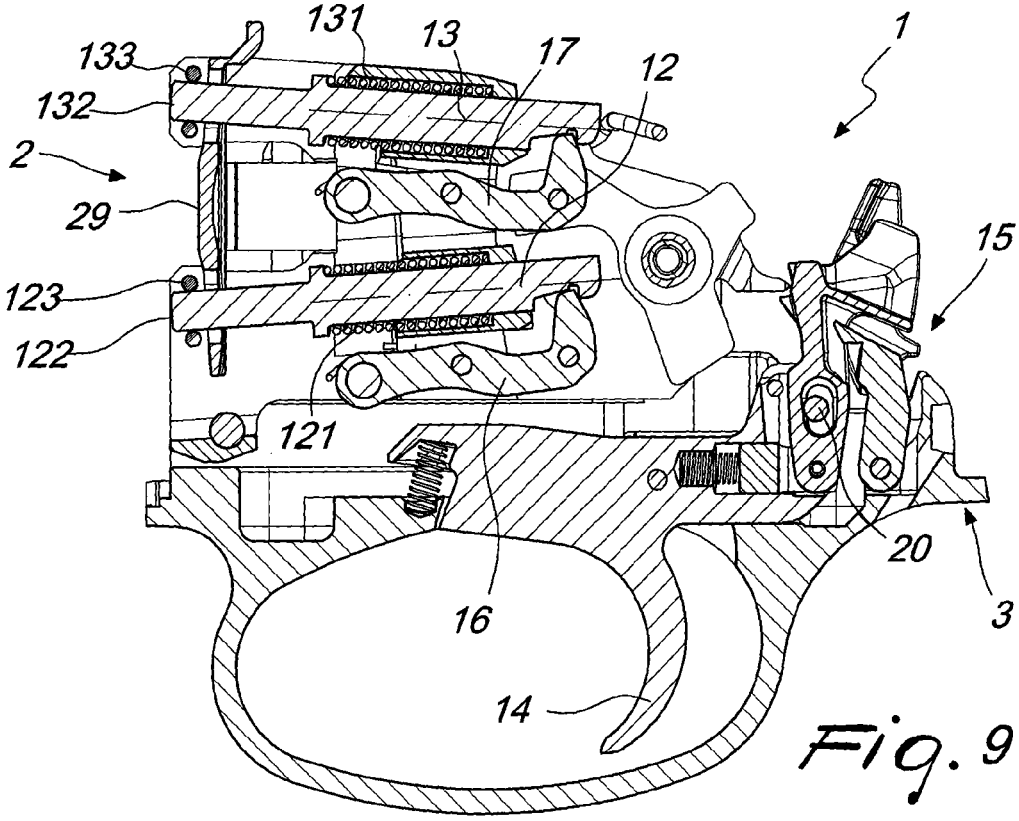
FIG. 9 is a sectional side view of the left side of the trigger assembly.
Figure 10:
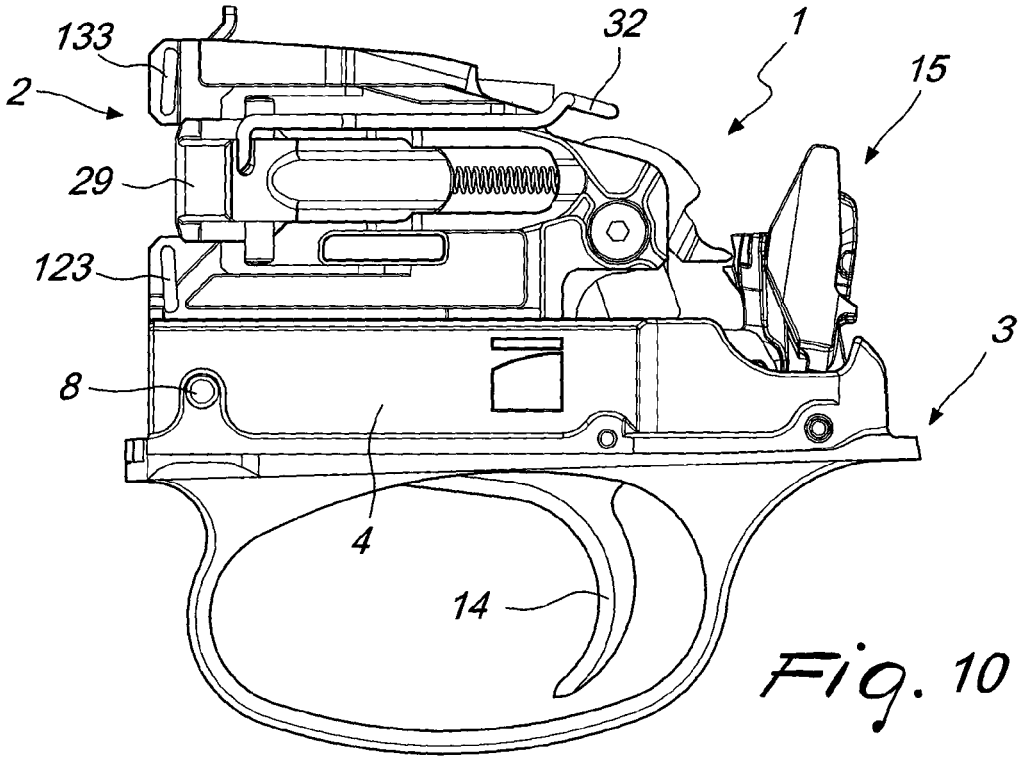
FIG. 10 is a side view of the left side of the trigger assembly.
Figure 11:
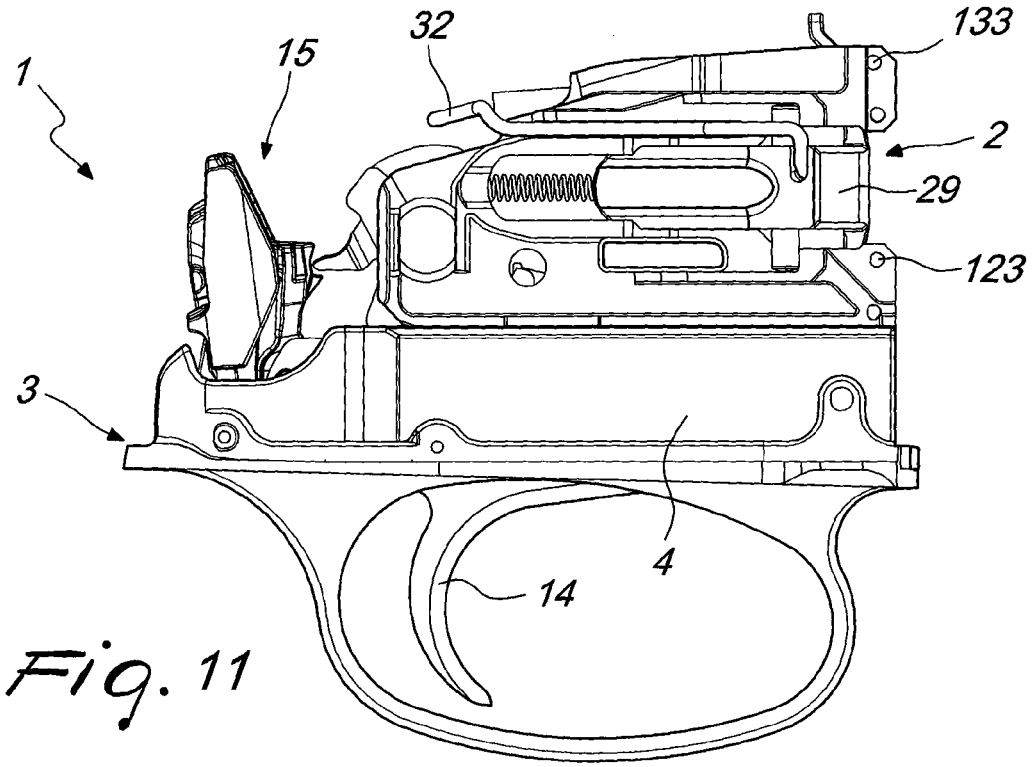
FIG. 11 is a side view of the right side of the trigger assembly.
Figure 12:
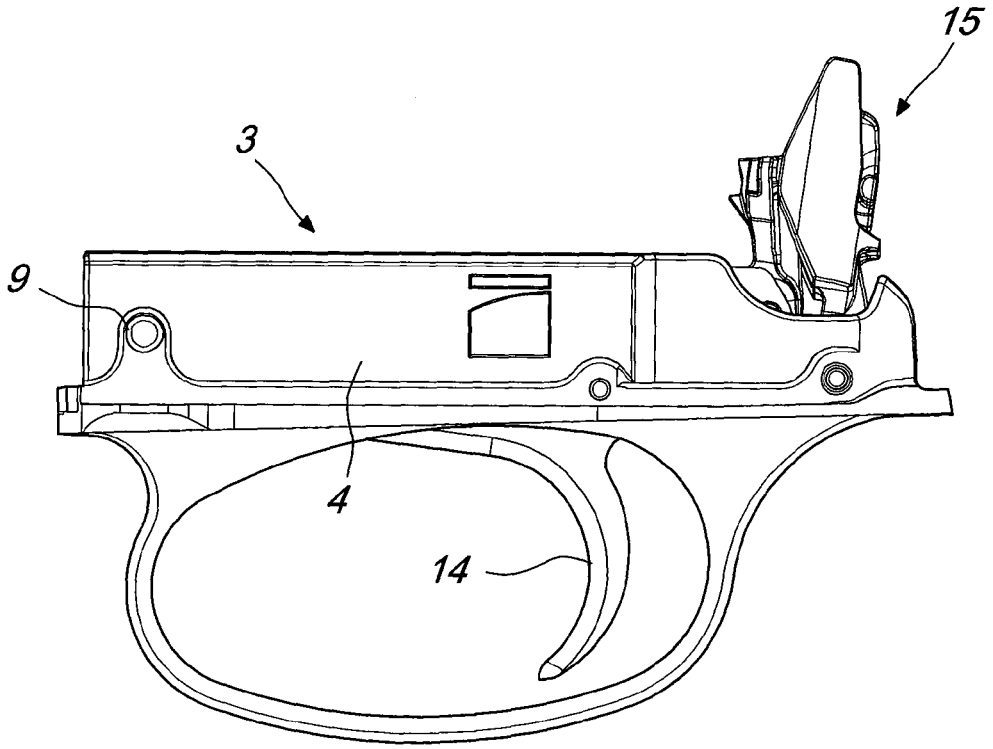
FIG. 12 is a side view of the left side of the trigger unit.
Figure 13:
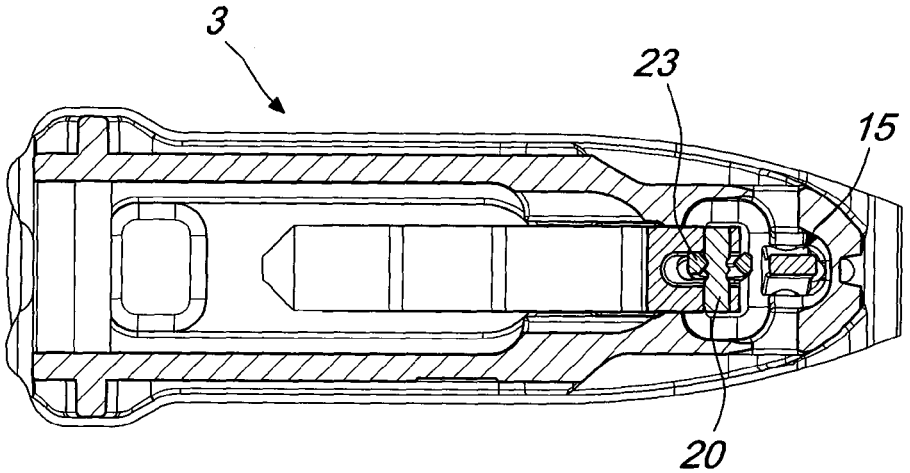
FIG. 13 is a plan view of the trigger unit, in which the selector is shown in the second shot position.
Figure 14:
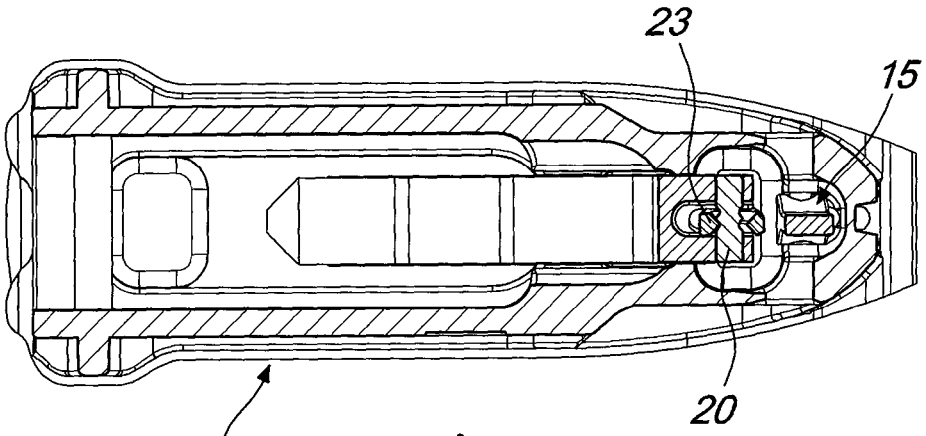
FIG. 14 is a plan view of the trigger unit, in which the selector is shown in the first shot position.
Figure 15:
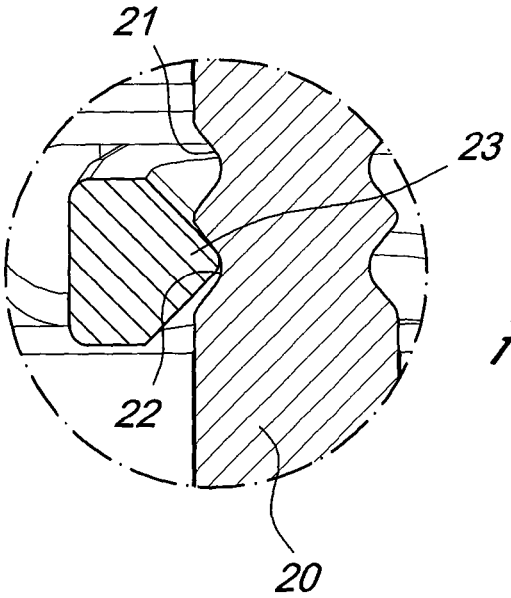
FIG. 15 is an enlarged-scale view of FIG. 14, showing the selector on the first shot.
Figure 16:
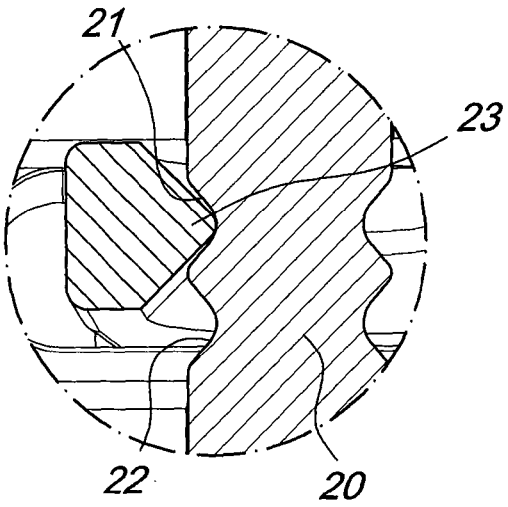
FIG. 16 is an enlarged-scale view of FIG. 13, showing the selector on the second shot.
Figure 17:
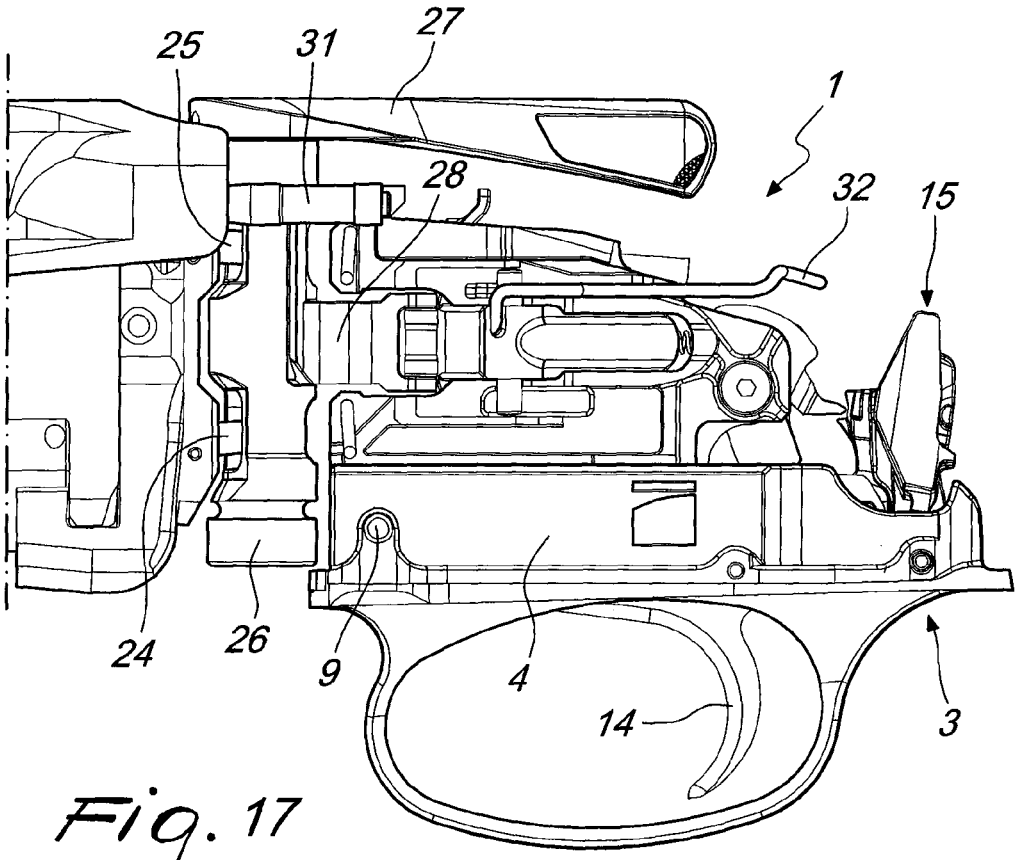
FIG. 17 is a partially cutout side view showing the left side of the trigger assembly and a portion of the break action.

With reference to the cited figures, the interchangeable trigger assembly according to the invention, designated by the reference numeral 1, is adapted to be mounted within a break action 101 of a rifle 100, by insertion in a lower opening 102 of the break action 101.

The trigger assembly 1 includes two portions that can be separated: a firing unit 2 and a trigger unit 3.

The firing unit 2 is arranged above the trigger unit 3 and is preferably made of steel and includes the members that are responsible for firing, i.e., the rocker arms, the trigger levers, the hammers and the hammer stroke limiting plate.

The trigger unit 3, arranged below the firing unit 2, is preferably made of aluminum and includes the actuation members, i.e., the trigger and the selector.

The trigger unit 3 is formed in a frame 4 provided with a longitudinal seat 5 in which the firing unit 2 can be partially inserted.

The longitudinal seat 5 has splined guides 6 that accommodate protrusions 7 formed in the firing unit 2.

The firing unit 2 is locked in the operating position by means of a pin 8 which engages lateral holes 9, formed in the front part of the frame 4 of the trigger unit 3, and front holes 10, formed in a front portion 11 of the firing unit 2.

The embodiment illustrated herein is designed as a trigger assembly for an over/under gun. However, it is evident to the person skilled in the art that the trigger assembly according to the present invention may be advantageously employed also in firearms of a different type.

With reference to an over/under firearm with two barrels 103, the firing unit 2 includes two hammers: respectively, an upper hammer 13 and a lower hammer 12, which are actuated by a single trigger 14 mounted on the trigger unit 3, by means of a selector 15.

Advantageously, the selector 15 is an inertial selector which alternately actuates a lower rocker arm 18 of the lower hammer and an upper rocker arm 19 of the upper hammer, which in turn act on a respective trigger lever 17 of the upper hammer and trigger lever 16 of the lower hammer. The terms lower and upper, with reference to the rocker arms, do not indicate a particular spatial arrangement of one with respect to the other but rather their respective relationship with the hammers.

The selector includes a selector pin 20, which constrains the position of the selector during firing. To this purpose, the selector pin 20 has a pair of recesses 21 and 22 which are engaged alternatively by a raised portion 23 of the selector 15.

Each hammer 12 and 13 slides along its own longitudinal axis in contrast with a respective spring 121 and 131 and ends with an active end, respectively 122 and 132, at which there is a guide 123 and 133, advantageously provided in the form of a U-shaped wire.

The end 122 of the lower hammer 12 acts on a lower firing pin 24 and the end 132 of the upper hammer 13 acts on an upper firing pin 25.

The firing pins 24 and 25 are mounted in the break action 101.

The actuation lever 27 is monolithic and is constituted by a vertical cylindrical body 26 and by a tab through which the rotary motion is applied to the actuation lever.

The actuation lever 27 has the dual function of rearming the hammers 12 and 13 and of allowing the opening of the barrels 103.

The first function of the actuation lever, i.e., rearming the hammers, occurs by means of an arming lever 28; the rotation of the actuation lever causes the arming lever 28 to act, by means of a cylindrical body, on one of the two lateral cams of a hammer stroke limiting plate 29, which is associated with the firing unit 2, making it retract.

The retraction of the hammer stroke limiting plate causes the arming of the hammers and the retraction of a shaped rod 32, which acts on a safety system, generally designated by the reference numeral 30, which is mounted on the break action 101 and acts on the selector 15.

The presence of two lateral cams 291 and 292, in the hammer stroke limiting plate 29, allows the use of right-handed and left-handed actuation levers without modifying the trigger assembly 1.

Figure 20:
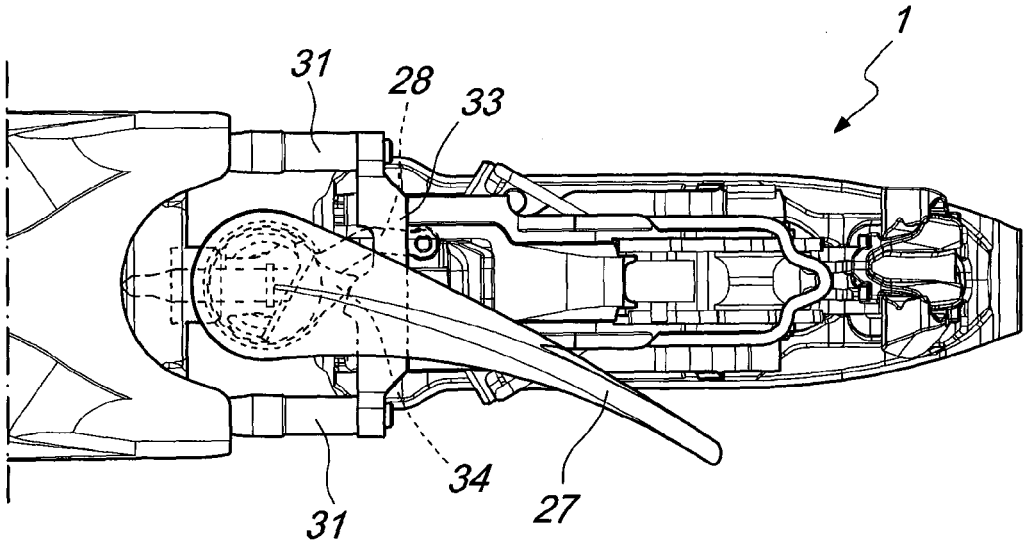
FIG. 20 is a partially cutout plan view, showing the trigger assembly and a portion of the break action, with a left-handed lever shown in a rotated position.

FIG. 20 shows an example of application of a left-handed actuation lever 27, which is identical, in a mirror-symmetrical manner, to the right-handed actuation lever 27 shown in the preceding figures.

The second function of the actuation lever 27, i.e., opening the barrels, occurs by means of a second cam 34, which acts on a bar 33, making it retract, entraining a pair of closure pins 31, which lock the barrels 103 in the break action 101. The opening of the barrels depends on the arming of the hammers and on the safing of the firearm by means of the shaped rod 32.

In practice it has been found that the invention achieves the intended aim and objects, providing an interchangeable trigger assembly, with modular characteristics, that allows to vary the functional characteristics of the firearm rapidly and easily and without the intervention of specialized personnel, making available to the user trigger assemblies with different characteristics that can be applied selectively to the same firearm according to the specific requirements.

The modular construction, in two parts, of the trigger assembly allows easy interchangeability of calibers because the same trigger unit may be associated with different firing units, each adapted to a specific gauge, for example 12 gauge and 20 gauge.

The particular construction of the assembly allows, by virtue of the rocker arms, to modify the stroke and the trigger force.

A further advantage of the present trigger assembly is constituted by the fact that the opening of the barrels depends upon the arming and safing of the firearm.

Figure 18:
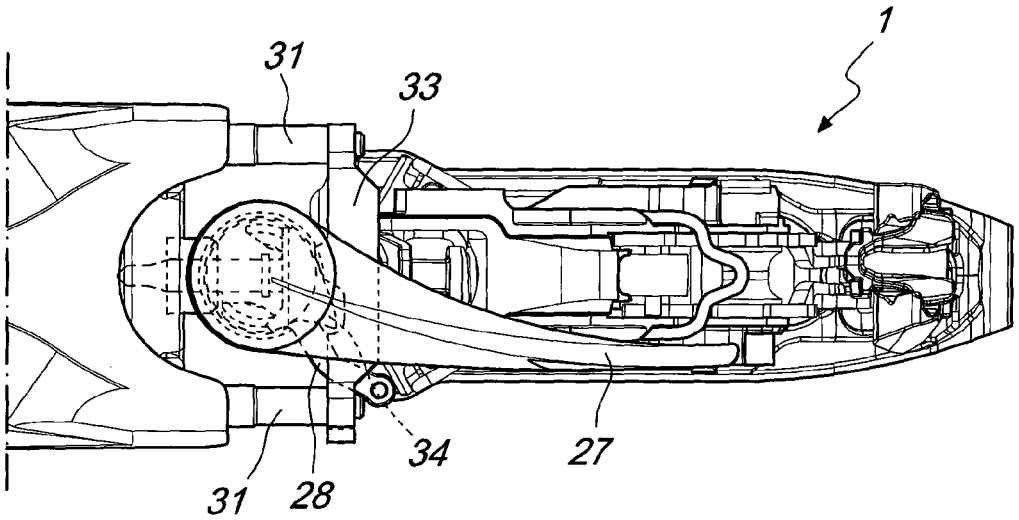
FIG. 18 is a partially cutout plan view showing the trigger assembly and a portion of the break action with a right-handed lever.
Figure 19:
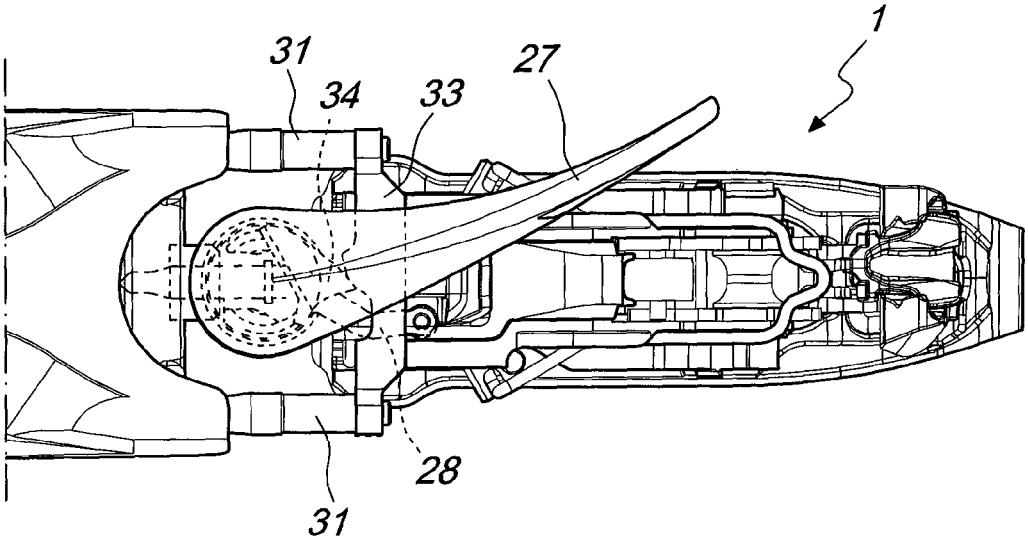
FIG. 19 is a partially cutout plan view, showing the trigger assembly and a portion of the break action, illustrating the right-handed lever in a rotated position.

The trigger assembly is designed to allow the use of right-handed and left-handed actuation levers to rearm the hammers and open the barrels, without applying any modification to the components of the assembly itself. It is in fact sufficient to replace the right-handed actuation lever, visible in FIGS. 18 and 19, with a left-handed actuation lever, visible in FIG. 20, without replacing the hammer stroke limiting plate 29 or any other component of the assembly, since the hammer stroke limiting plate 29 has two mirror-symmetrical lateral wings 291 and 292, on each of which the right-handed or left-handed lever 28 of the actuation lever 27 acts alternately.

The trigger assembly according to the invention is susceptible of numerous modifications and variations, within the scope of the inventive concept; all the details may be replaced with technically equivalent elements.

The materials used, as well as the dimensions, may be any according to the requirements and the state of the art.

This application claims the priority of Italian Patent Application No. MI2014A002274, filed on Dec. 30, 2014, the subject matter of which is incorporated herein by reference.

The invention claimed is:

1. An interchangeable trigger assembly for firearms, for use with a break action of a rifle by insertion in a lower opening of said break action; said interchangeable assembly comprising two detachable portions: a firing unit and a trigger unit, said firing unit comprising firing members cooperating with one another to act on at least one firing pin of a firearm, said firing members including actuation members; said trigger unit comprising at least one trigger which acts on said actuation members of said firing members; said firing unit being detachably connected to said trigger unit.

2. The trigger assembly according to claim 1, wherein said firing members comprise rocker arms, trigger levers, hammers and hammer stroke limiting means disposed in operative relationship with respect to one another for acting on said at least one firing pin.

3. The trigger assembly according to claim 1, wherein said at least one firing pin is one of two firing pins of said firearm, said firing members including two rocker arms, two trigger levers, and two hammers, said actuation members further comprising a selector configured for enabling alternative actuation of said rocker arms individually.

4. The trigger assembly according to claim 1, wherein said trigger unit is configured for connection to different firing units, each adapted for a respective specific caliber.

5. The trigger assembly according to claim 4, wherein said rocker arms in said firing unit are configured for effective actuation in response to different strokes of said trigger and different trigger forces.

6. The trigger assembly according to claim 1, wherein said trigger unit includes a frame provided with a longitudinal seat wherein said firing unit is at least partially inserted; said longitudinal seat comprising splined guides adapted to accommodate protrusions formed in said firing unit.

7. The trigger assembly according to claim 1, wherein said firing unit comprises two hammers: respectively an upper hammer and a lower hammer, actuated by a single trigger by means of a selector mounted in said trigger unit.

8. The trigger assembly according to claim 7, wherein said selector is an inertial selector and alternatively actuates a lower rocker arm of said lower hammer and an upper rocker arm of said upper hammer; said rocker arms acting on respective trigger levers of said upper hammer and of said lower hammer.

9. The trigger assembly according to claim 7, wherein said selector comprises a selector pin and a protrusion; said selector pin constraining the position of the selector so that one and only one of said hammers is actuated during firing; said selector pin comprising a pair of recesses that are alternately engaged by said protrusion to set or select an actuation path from said trigger to a selected one of said hammers.

10. The trigger assembly according to claim 7, wherein each of said hammers slides along its own longitudinal axis in contrast with a respective spring and ends with an active end; a guide, provided at said active end, being in the form of a U-shaped wire.

11. The trigger assembly according to claim 7, wherein said end of said lower hammer acts on a lower firing pin and said end of said upper hammer acts on an upper firing pin; said firing pins being mounted in said break action.

12. The trigger assembly according to claim 1, wherein the opening of barrels of the firearm is dependent upon arming of the firearm and activation of a safety system thereof.

13. The trigger assembly according to claim 1, further comprising an actuation lever that has an arming lever and a barrel-unlocking cam; said arming lever acting on a hammer stroke limiting plate provided with at least one lateral cam or camming surface and included as part of said firing unit; a rotation of said actuation lever causing said arming lever to act on said at least one lateral cam or camming surface of said hammer stroke limiting plate, so as to retract said hammer stroke limiting plate and arm or cock the hammers; said cam of said actuation lever being operatively connected to a pair of closure pins for retracting the closure pins to allowing the an opening of barrels of the firearm after a full rearming or cocking of said hammers and activation of a safety system of the firearm.

14. The trigger assembly according to claim 13, wherein said hammer stroke limiting plate is provided with two lateral cams or camming surfaces, which allow the rearming or cocking of said hammers with a rotation of said actuation lever in an angular direction taken from the group of clockwise and counterclockwise.

15. An interchangeable trigger assembly for firearms, for use with a break action of a rifle by insertion in a lower opening of said break action; said interchangeable assembly comprising two detachable portions: a firing unit and a trigger unit, said firing unit comprising firing members cooperating with one another to act on at least one firing pin of a firearm, said firing members including actuation members; said trigger unit comprising at least one trigger which acts on said actuation members of said firing members; said firing unit being detachably connected to said trigger unit, said trigger unit including a frame provided with a longitudinal seat wherein said firing unit is at least partially inserted; said longitudinal seat comprising splined guides adapted to accommodate protrusions formed in said firing unit, said firing unit being releasably locked in said trigger unit by means of a pin, which engages lateral holes, formed in a front portion of said frame of the trigger unit, and front holes, formed in a front portion of said firing unit.

* * * * *